US010196820B2

(12) United States Patent
Sorkin

(10) Patent No.: US 10,196,820 B2
(45) Date of Patent: Feb. 5, 2019

(54) ENCAPSULATED SPLICE CHUCK

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 15/648,127

(22) Filed: Jul. 12, 2017

(65) Prior Publication Data

US 2018/0016789 A1 Jan. 18, 2018

Related U.S. Application Data

(60) Provisional application No. 62/362,285, filed on Jul. 14, 2016.

(51) Int. Cl.

| | |
|---|---|
| ***E04C 5/08*** | (2006.01) |
| ***E04C 5/16*** | (2006.01) |
| ***E04C 5/12*** | (2006.01) |
| *E04G 21/12* | (2006.01) |

(52) U.S. Cl.

CPC ..... *E04C 5/165* (2013.01); *E04C 5/08* (2013.01); *E04C 5/122* (2013.01); *E04G 21/121* (2013.01)

(58) Field of Classification Search

CPC ..... E04C 5/165; E04C 5/08
USPC ..... 52/223.1
See application file for complete search history.

(56) References Cited

U.S. PATENT DOCUMENTS

| | | | |
|---|---|---|---|
| 4,896,470 | A | 1/1990 | Sorkin |
| 5,072,558 | A | 12/1991 | Sorkin et al. |
| 5,440,842 | A | 8/1995 | Sorkin |
| 5,701,707 | A | 12/1997 | Sorkin |
| 5,720,139 | A | 2/1998 | Sorkin |
| 5,749,185 | A | 5/1998 | Sorkin |
| 5,755,065 | A | 5/1998 | Sorkin |
| 5,770,286 | A | 6/1998 | Sorkin |
| 5,788,398 | A | 8/1998 | Sorkin |
| 5,839,235 | A | 11/1998 | Sorkin |
| 5,897,102 | A | 4/1999 | Sorkin |
| 6,012,867 | A | 1/2000 | Sorkin |
| 6,017,165 | A | 1/2000 | Sorkin |
| 6,023,894 | A | 2/2000 | Sorkin |

(Continued)

FOREIGN PATENT DOCUMENTS

| | | | |
|---|---|---|---|
| JP | H0718788 | A | 1/1995 |
| KR | 20100089378 | A | 8/2010 |

OTHER PUBLICATIONS

Extended Search Report issued in European Application No. 17181165.6, dated Nov. 23, 2017, 7 pages.

*Primary Examiner* — Basil S Katcheves
(74) *Attorney, Agent, or Firm* — Adolph Locklar

(57) ABSTRACT

An encapsulated splice chuck may include a splice chuck body and a body encapsulation positioned about an exterior surface of the splice chuck body. The encapsulated splice chuck may also include a first forcing cone threadedly coupled to the splice chuck body, the first forcing cone including a tapered inner surface. In addition, the encapsulated splice chuck may include a first forcing cone encapsulation positioned about an exterior surface of the first forcing cone and a first set of wedges positioned within the first forcing cone. The encapsulated splice chuck may include a second forcing cone mechanically coupled to the splice chuck body, the second forcing cone including a tapered inner surface, and a second forcing cone encapsulation positioned about an exterior surface of the second forcing cone. The encapsulated splice chuck may also include a second set of wedges positioned within the second forcing cone.

18 Claims, 5 Drawing Sheets

(56) References Cited

U.S. PATENT DOCUMENTS

| | | | |
|---|---|---|---|
| 6,027,278 | A | 2/2000 | Sorkin |
| 6,098,356 | A | 8/2000 | Sorkin |
| 6,151,850 | A | 11/2000 | Sorkin |
| 6,176,051 | B1 | 1/2001 | Sorkin |
| 6,234,709 | B1 | 5/2001 | Sorkin |
| 6,381,912 | B1 | 5/2002 | Sorkin |
| 6,393,781 | B1 | 5/2002 | Sorkin |
| 6,513,287 | B1 | 2/2003 | Sorkin |
| 6,560,939 | B2 | 5/2003 | Sorkin |
| 6,631,596 | B1 | 10/2003 | Sorkin |
| 6,761,002 | B1 | 7/2004 | Sorkin |
| 6,817,148 | B1 | 11/2004 | Sorkin |
| 6,843,031 | B1 | 1/2005 | Sorkin |
| 7,424,792 | B1 | 9/2008 | Sorkin |
| 7,676,997 | B1 | 3/2010 | Sorkin |
| D615,219 | S | 5/2010 | Sorkin |
| 7,823,345 | B1 | 11/2010 | Sorkin |
| 7,841,061 | B1 | 11/2010 | Sorkin |
| 7,856,774 | B1 | 12/2010 | Sorkin |
| 7,866,009 | B1 | 1/2011 | Sorkin |
| 7,950,196 | B1 | 5/2011 | Sorkin |
| 8,015,774 | B1 | 9/2011 | Sorkin |
| 8,065,845 | B1 | 11/2011 | Sorkin |
| 8,069,624 | B1 | 12/2011 | Sorkin |
| 8,087,204 | B1 | 1/2012 | Sorkin |
| 8,251,344 | B1 | 8/2012 | Sorkin |
| 9,097,014 | B1 | 8/2015 | Sorkin |

ENCAPSULATED SPLICE CHUCK

CROSS-REFERENCE TO RELATED APPLICATIONS

This application is a nonprovisional application which claims priority from U.S. provisional application No. 62/362,285, filed Jul. 14, 2016.

TECHNICAL FIELD/FIELD OF THE DISCLOSURE

The present disclosure relates to post-tension anchorage systems.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a specified strength by use of a post-tensioning tendon. Traditionally, a tension member is constructed of a suitable material exhibiting tensile strength which can be elongated including, for example, reinforcing steel, single or multi-strand cable. Typically, the tension member may be formed from a metal or composite material.

SUMMARY

Certain embodiments of the present disclosure are directed to an encapsulated splice chuck. The encapsulated splice chuck includes a splice chuck body and a body encapsulation positioned about an exterior surface of the splice chuck body. The encapsulated splice chuck also includes a first forcing cone threadedly coupled to the splice chuck body, the first forcing cone including a tapered inner surface. In addition, the encapsulated splice chuck includes a first forcing cone encapsulation positioned about an exterior surface of the first forcing cone and a first set of wedges positioned within the first forcing cone. The encapsulated splice chuck includes a second forcing cone mechanically coupled to the splice chuck body, the second forcing cone including a tapered inner surface, and a second forcing cone encapsulation positioned about an exterior surface of the second forcing cone. The encapsulated splice chuck also includes a second set of wedges positioned within the second forcing cone.

Other embodiments of the present disclosure are directed to a method. The method includes providing an encapsulated splice chuck. The encapsulated splice chuck includes a splice chuck body and a body encapsulation positioned about an exterior surface of the splice chuck body. The encapsulated splice chuck also includes a first forcing cone threadedly coupled to the splice chuck body, the first forcing cone including a tapered inner surface. In addition, the encapsulated splice chuck includes a first forcing cone encapsulation positioned about an exterior surface of the first forcing cone and a first set of wedges positioned within the first forcing cone. The encapsulated splice chuck includes a second forcing cone mechanically coupled to the splice chuck body, the second forcing cone including a tapered inner surface, and a second forcing cone encapsulation positioned about an exterior surface of the second forcing cone. The encapsulated splice chuck also includes a second set of wedges positioned within the second forcing cone. The method also includes providing a first and second tension member, each tension member including a strand and inserting the strand of the first tension member into the first set of wedges within the first forcing cone. The method additionally includes inserting the strand of the second tension member into the second set of wedges within the second forcing cone and applying tension to the first and second tension members to pull the first and second sets of wedges into the first and second forcing cones and retard the first and second tension members from being removed from the encapsulated splice chuck.

Yet other embodiments of the present disclosure are directed to a system. The system includes a concrete form and a post-tensioning tendon. The post-tensioning tendon includes a first anchor, a second anchor, a first tension member, a second tension member, and an encapsulated splice chuck mechanically coupled to the first and second tension members. The encapsulated splice chuck includes a splice chuck body and a body encapsulation positioned about an exterior surface of the splice chuck body. The encapsulated splice chuck also includes a first forcing cone threadedly coupled to the splice chuck body, the first forcing cone including a tapered inner surface. In addition, the encapsulated splice chuck includes a first forcing cone encapsulation positioned about an exterior surface of the first forcing cone and a first set of wedges positioned within the first forcing cone. The encapsulated splice chuck includes a second forcing cone mechanically coupled to the splice chuck body, the second forcing cone including a tapered inner surface, and a second forcing cone encapsulation positioned about an exterior surface of the second forcing cone. The encapsulated splice chuck also includes a second set of wedges positioned within the second forcing cone.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
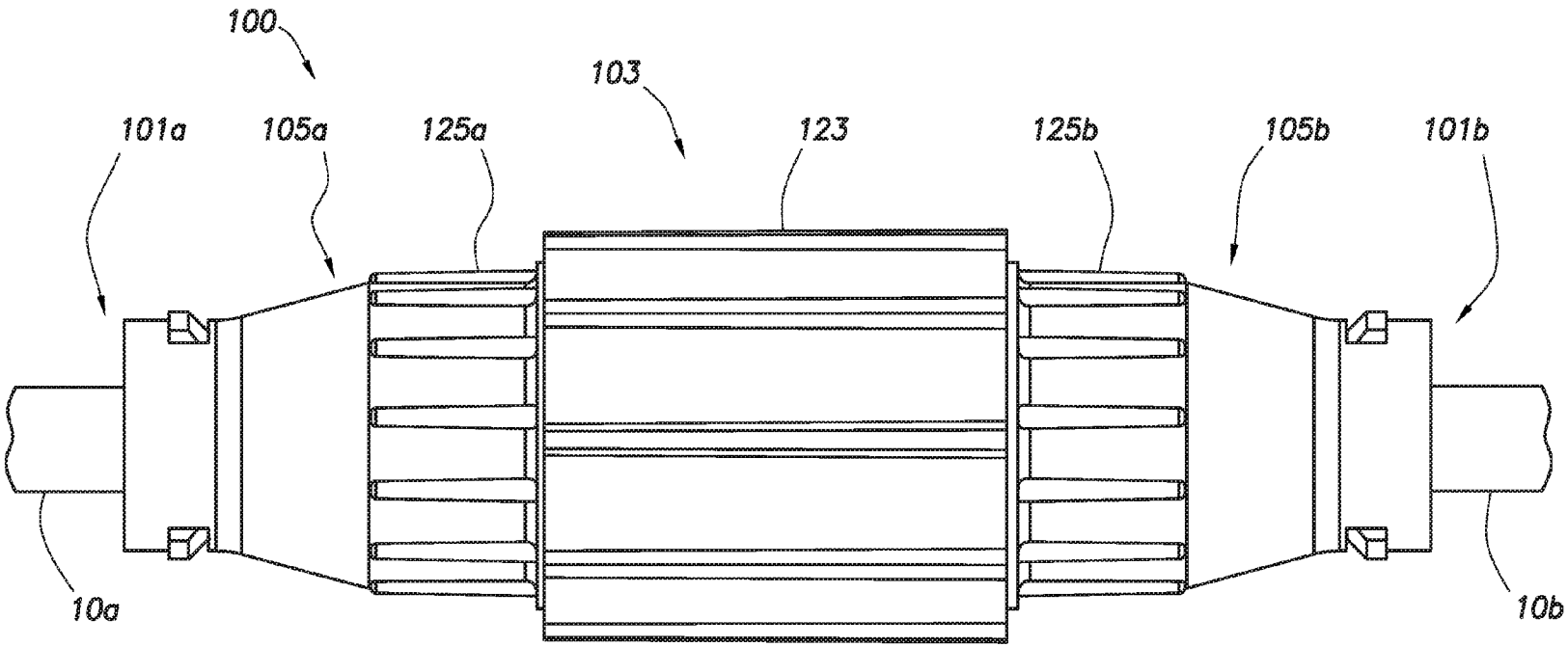
FIG. 1 depicts a side view of an encapsulated splice chuck consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a side view of encapsulated splice chuck 100 consistent with at least one embodiment of the present disclosure. In some embodiments, first tension member 10*a* may join to first end 101*a* of encapsulated splice chuck 100 and second tension member 10*b* may join to second end 101*b* of encapsulated splice chuck 100. In some embodiments, encapsulated splice chuck 100 may mechanically couple first tension member 10*a* to second tension member 10*b*.

Figure 2:
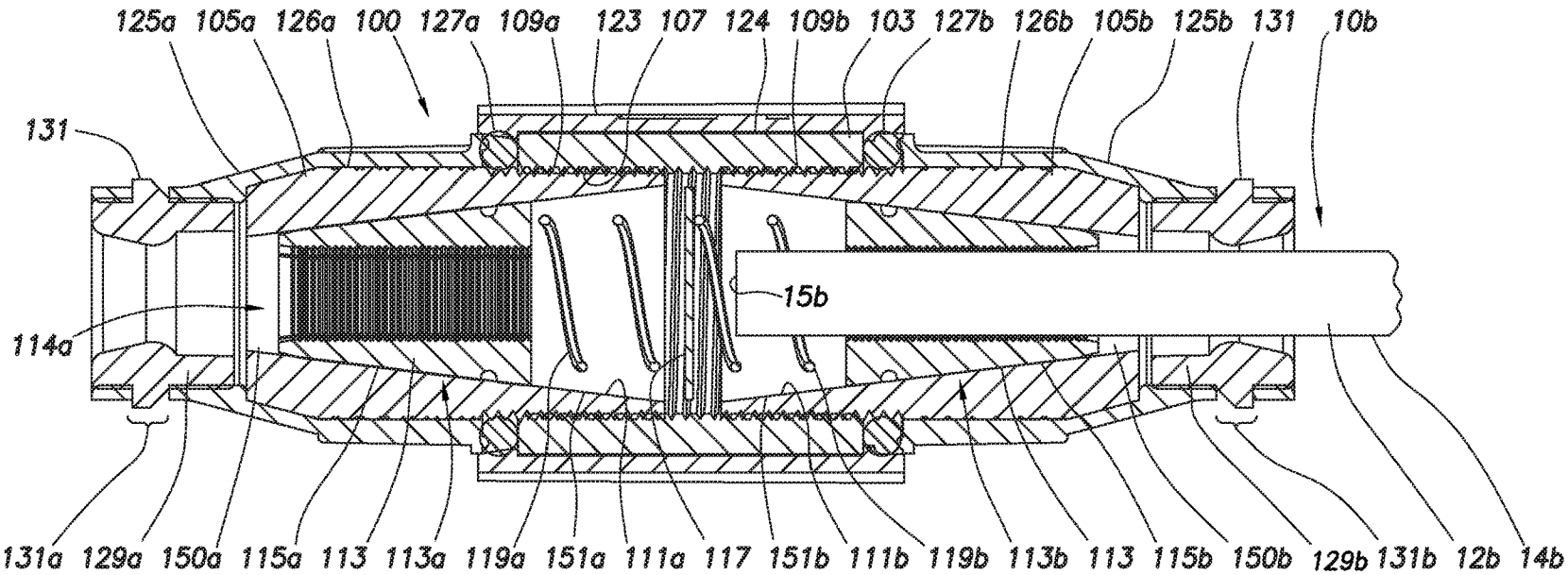
FIG. 2 depicts a cross section view of an encapsulated splice chuck consistent with at least one embodiment of the present disclosure.
Figure 3:
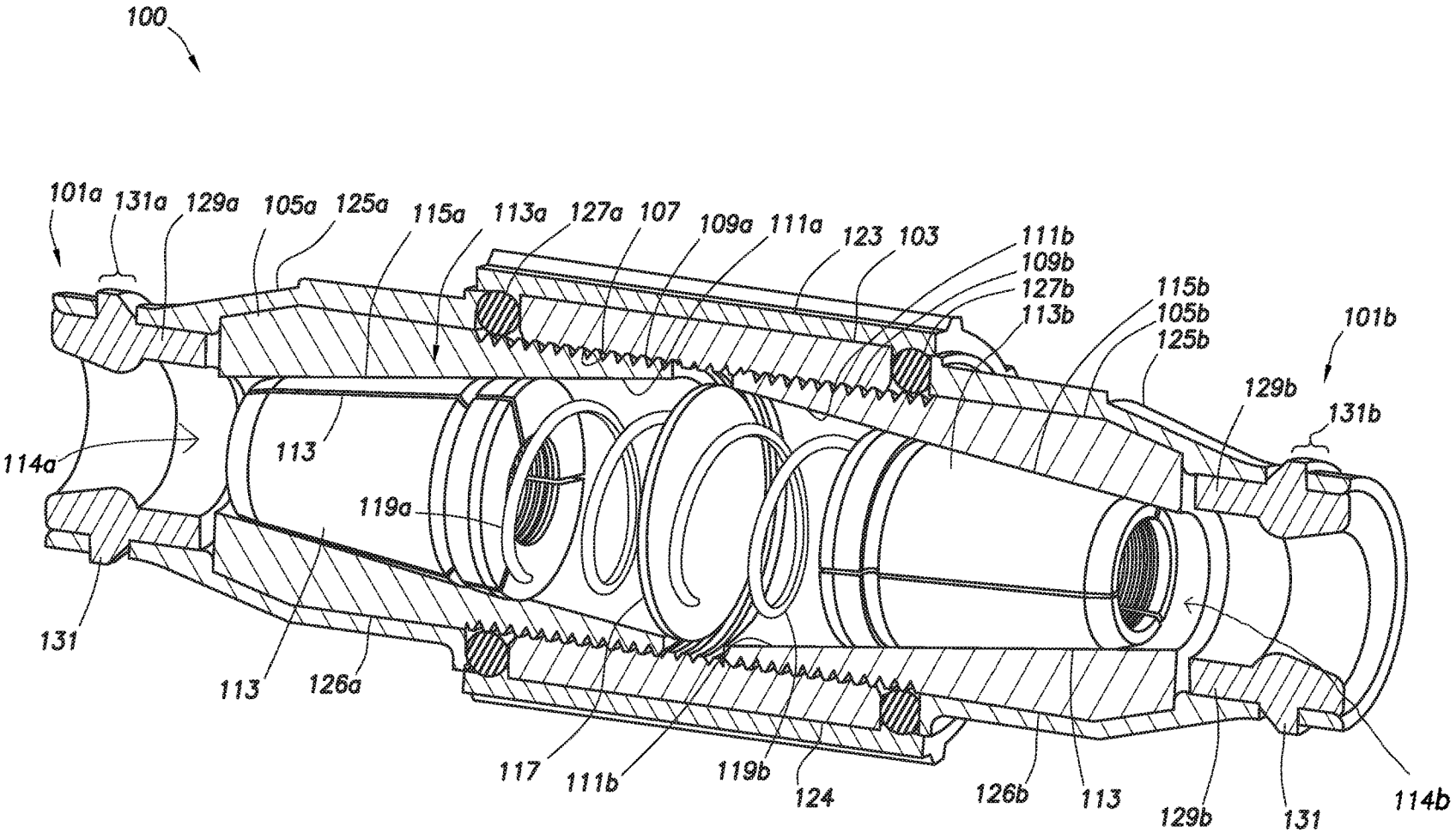
FIG. 3 depicts a perspective cutaway view of an encapsulated splice chuck consistent with at least one embodiment of the present disclosure.

In some embodiments, as depicted in FIGS. 2, 3, encapsulated splice chuck 100 may include splice chuck body 103, first forcing cone 105*a*, and second forcing cone 105*b*. In certain non-limiting embodiments, splice chuck body 103 may be tubular or annular. In some embodiments, splice chuck body 103 may include internal thread 107 and each forcing cone 105*a*, 105*b* may include external thread 109*a*, 109*b*. The combination of internal thread 107 and external thread 109*a*, 109*b* may be adapted to allow each forcing cone 105*a*, 105*b* to threadedly couple to splice chuck body 103.

In some embodiments, forcing cones 105*a*, 105*b* may include tapered inner surfaces 111*a*, 111*b* respectively. Tapered inner surfaces 111*a*, 111*b* may taper such that the inner diameter of forcing cone 105*a* is smaller at outside end 150*a* of forcing cone 105*a* than inside end 151*a* of forcing cone 105*a* and that the inner diameter of forcing cone 105*b* is smaller at outside end 150*b* of forcing cone 105*b* than inside end 151*b* of forcing cone 105*b*.

In some embodiments, encapsulated splice chuck 100 may also include wedges 113. Wedges 113 may be included in first set of wedges 113*a* and second set of wedges 113*b*. First and second sets of wedges 113*a*, 113*b* may be positioned within first and second forcing cones 105*a*, 105*b*, respectively. First and second sets of wedges 113*a*, 113*b* may include tapered outer surfaces 115*a*, 115*b*, which may match tapered inner surfaces 111*a*, 111*b* of forcing cones 105*a*, 105*b*. In some embodiments, each of first set of wedges 113*a* and second set of wedges 113*b* may include two or more wedges 113 positioned radially about the interior of forcing cones 105*a*, 105*b*. In some embodiments, each of first set of wedges 113*a* and second set of wedges 113*b* may define a generally cylindrical interior surface 114*a*, 114*b*, respectively.

In some embodiments, encapsulated splice chuck 100 may include central disk 117. Central disk 117 may be positioned within splice chuck body 103, and may separate first end 101*a* and second end 101*b* of encapsulated splice chuck 100. In some embodiments, encapsulated splice chuck 100 may include springs 119*a*, 119*b*. Spring 119*a* may extend between first set of wedges 113*a* and central disk 117, and spring 119*b* may extend between second set of wedges 113*b* and central disk 117. Springs 119*a*, 119*b* may bias first and second sets of wedges 113*a*, 113*b* into the respective forcing cone 105*a*, 105*b*. Springs 119*a*, 119*b* may be formed of metal, such as steel, or a polymer. In certain embodiments, springs 119*a*, 119*b* may be omitted.

In some embodiments, encapsulated splice chuck 100 may include body encapsulation 123. Body encapsulation 123 may be positioned about exterior surface 124 of splice chuck body 103. In some embodiments, each forcing cone 105*a*, 105*b* may be encapsulated by forcing cone encapsulation 125*a*, 125*b*. Forcing cone encapsulation 125*a*, 125*b* may be positioned about exterior surfaces 126*a*, 126*b* of the respective forcing cone 105*a*, 105*b*. In some embodiments, body encapsulation 123 may be molded to splice chuck body 103, and forcing cone encapsulation 125*a*, 125*b* may be molded to forcing cones 105*a*, 105*b*. In some embodiments, body encapsulation 123 and forcing cone encapsulation 125*a*, 125*b* may be formed from a polymer such as epoxy, phenolic resin, nylon, polyethylene (including, but not limited to, high density polyethylene (HDPE)), polystyrene, or combinations thereof, or any other suitable material.

In some embodiments, as each forcing cone 105*a*, 105*b* is threadedly coupled to splice chuck body 103, the respective forcing cone encapsulation 125*a*, 125*b* may at least partially engage body encapsulation 123. In some embodiments, encapsulated splice chuck 100 may include one or more seals 127*a*, 127*b* positioned between forcing cones 105*a*, 105*b* and splice chuck body 103. For example, first seal 127*a* may be positioned between forcing cone 105*a* and splice chuck body 103, and second seal 127*b* may be positioned between forcing cone 105*b* and splice chuck body 103. In some embodiments, seals 127*a*, 127*b* may include O-rings or any other suitable seal. In some embodiments, seals 127*a*, 127*b* may retard fluid ingress between body encapsulation 123 and forcing cone encapsulation 125*a*, 125*b*. In some embodiments, body encapsulation 123 and forcing cone encapsulation 125*a*, 125*b* may protect one or more of splice chuck body 103; forcing cones 105*a*, 105*b*; first and second sets of wedges 113*a*, 113*b*; central disk 117; springs 119*a*, 119*b*; and any portion of first and second tension members 10*a*, 10*b* within encapsulated splice chuck 100 from exposure to the surrounding environment, including, for example and without limitation, protection from moisture or other corrosive sources. In certain embodiments, seals 127*a*, 127*b* may be formed from a natural or synthetic rubber, including, but not limited to EPDM rubber.

In some embodiments, encapsulated splice chuck 100 may include sheathing seals 129*a*, 129*b*. Sheathing seals 129*a*, 129*b* may be positioned at first and second ends 101*a*, 101*b* respectively of encapsulated splice chuck 100. Sheathing seals 129*a*, 129*b* may be annular in shape. In some embodiments, sheathing seals 129*a*, 129*b* may mechanically couple to respective forcing cone encapsulation 125*a*, 125*b*. In some embodiments, for example and without limitation, each sheathing seal 129*a*, 129*b* may include one or more tabs 131 which may fit into matching slots 131*a*, 131*b* formed in forcing cone encapsulation 125*a*, 125*b*. Sheathing seals may be any satisfactory material, including, but not limited to a polymer.

In some embodiments, as depicted in FIG. 1, first and second tension members 10*a*, 10*b* may be mechanically coupled to encapsulated splice chuck 100. Each tension member 10*a*, 10*b* may be inserted into a respective end 101*a*, 101*b* of encapsulated splice chuck 100. As depicted in FIG. 2 with respect to second end 101*b* of encapsulated splice chuck 100, second tension member 10*b* may include strand 12*b*. Strand 12*b* may be inserted into second end 101*b* of encapsulated splice chuck 100. Strand 12*b* may press against second set of wedges 113*b* and fit through the generally cylindrical interior 114*b* thereof. In some embodiments, movement of second set of wedges 113*b* towards central disk 117 may be retarded by compression of spring 119*b*. In some embodiments, by placing tension on second tension member 10*b*, second set of wedges 113*b* may engage strand 12*b* and be pulled further into second forcing cone 105*b*. Tapered inner surface 111*b* of second forcing cone 105*b* may press second set of wedges 113*b* into strand 12*b* as second set of wedges 113*b* move into second forcing cone 105*b*. Strand 12*b* may thereby be prevented or retarded from being removed from encapsulated splice chuck 100 and second tension member 10*b* may thereby be mechanically coupled to encapsulated splice chuck 100.

In some embodiments, second tension member 10*b* may include sheathing 14*b*. Sheathing 14*b* may have an outer diameter substantially the same as or larger than an inner diameter of sheathing seal 129*b*. Sheathing 14*b* may, for example and without limitation, be close or press-fit into sheathing seal 129*b*. The close or press-fit between sheathing 14*b* and sheathing seal 129*b* may retard ingress of fluid into encapsulated splice chuck 100 through sheathing seal 129*b*. In some embodiments, a portion of sheathing 14*b* near the end 15*b* of second tension member 10*b* may be removed from second tension member 10*b* to allow a portion of strand 12*b* without sheathing 14*b* to enter second set of wedges 113*b*.

In some embodiments, first tension member 10*a* may be installed to first end 101*a* of encapsulated splice chuck 100 in substantially the same manner as second tension member 10*b* is installed to second end 101*b* of encapsulated splice chuck 100.

Figure 4A:
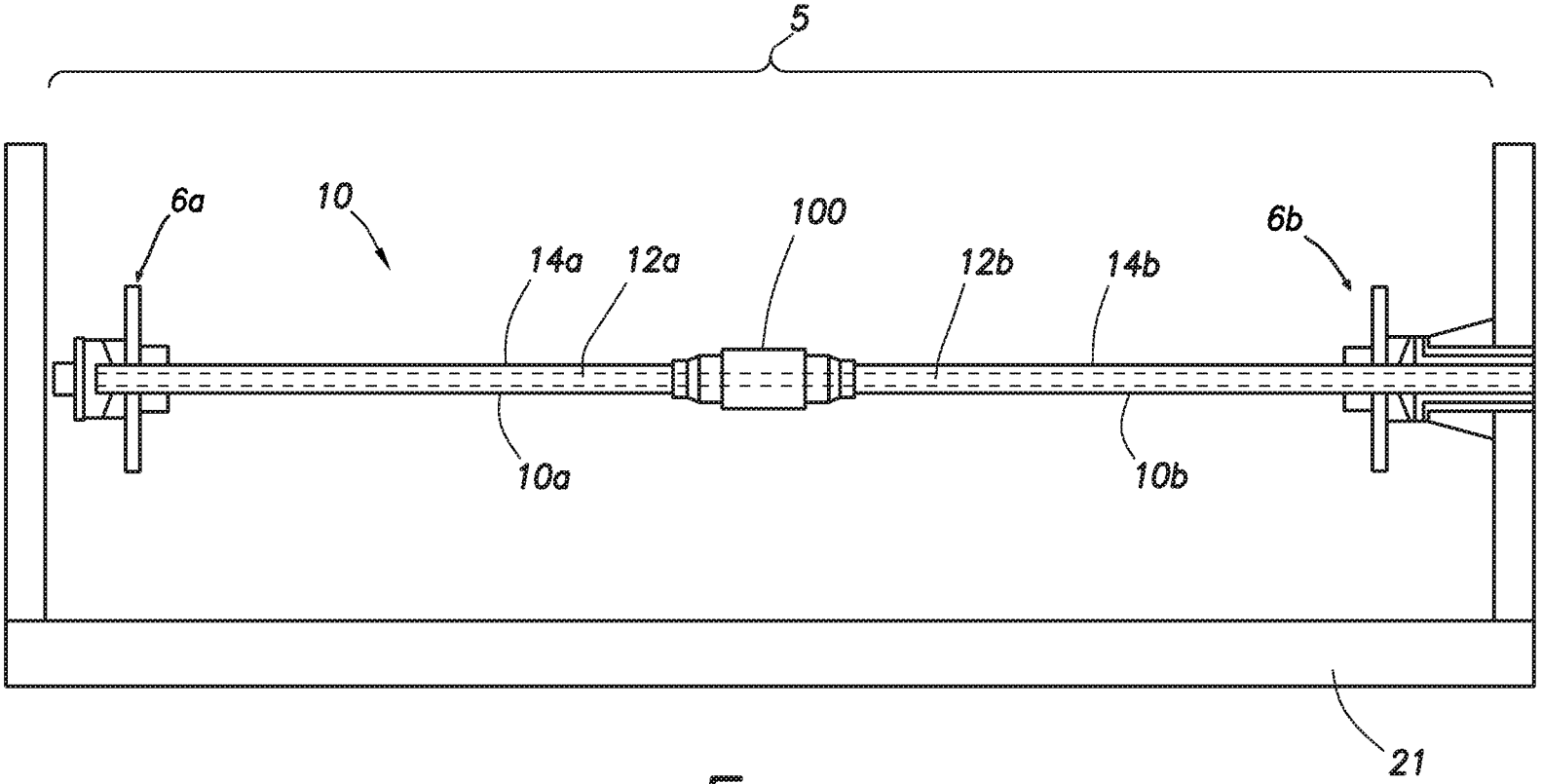
FIGS. 4A-4B depict an encapsulated splice chuck consistent with at least one embodiment of the present disclosure within an anchor assembly in a concrete segment.
Figure 4B:
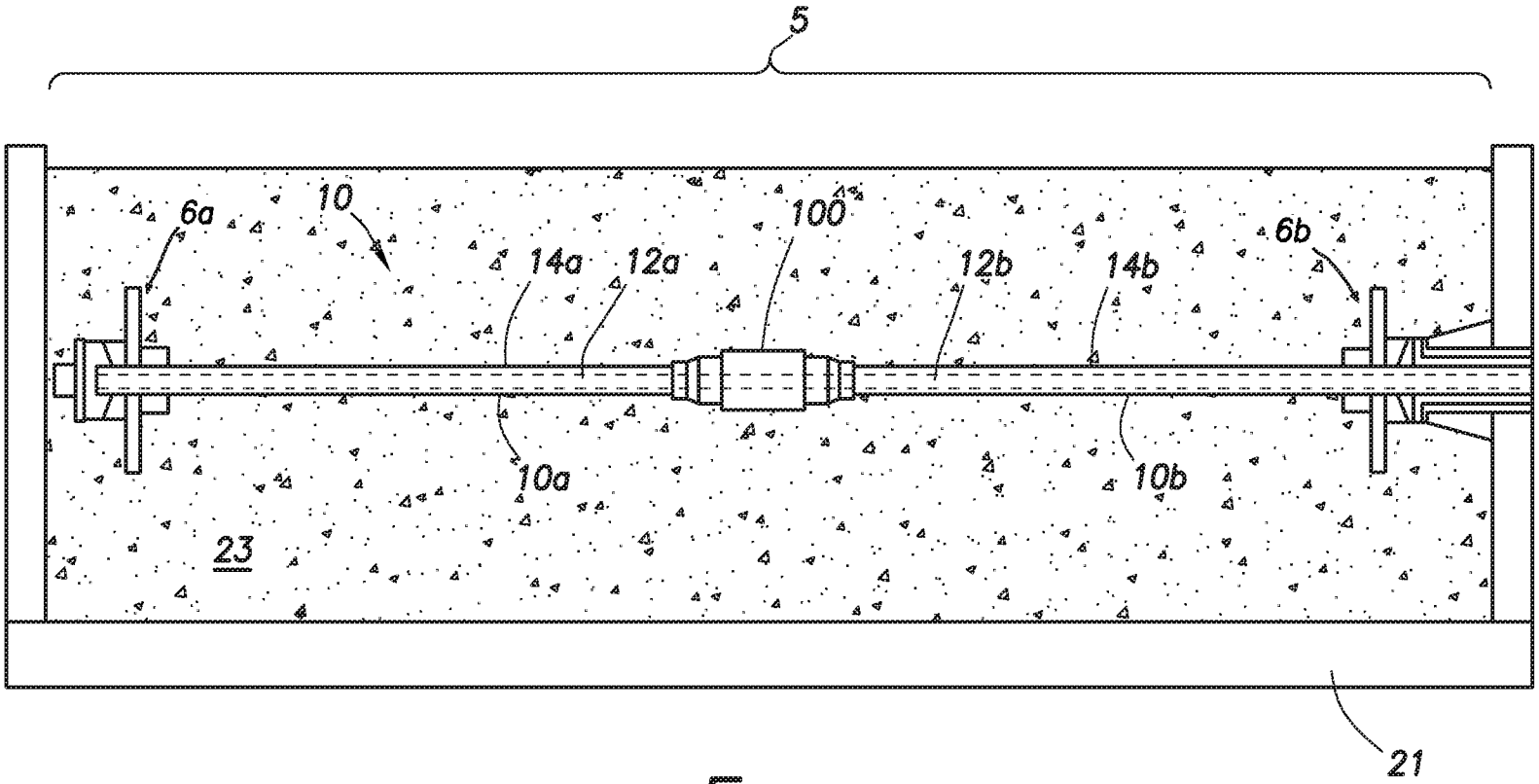

As shown in FIGS. 4A, 4B post-tensioning tendon 5 may include for example and without limitation, anchor assemblies 6*a*, 6*b* and tension member 10. In some embodiments, tension member 10 may include two or more tension member segments joined end to end, depicted as first and second tension members 10*a*, 10*b*. For example, tension member 10 may be severed during installation or two shorter lengths of tension member may be joined to form tension member 10. Each tension member 10*a*, 10*b* may include strands 12*a*, 12*b* and sheathings 14*a*, 14*b* as previously described. In some embodiments, a duct (not shown) may be positioned about tension member 10. Post-tensioning tendon 5 may be positioned within concrete form 21 such that it will be completely encased in concrete 23 as depicted in FIG. 4B. Tension members 10*a*, 10*b* may be joined by encapsulated splice chuck 100 as previously discussed.

The foregoing outlines features of several embodiments. Such features may be replaced by any one of numerous equivalent alternatives, only some of which are disclosed herein. Equivalent constructions do not depart from the scope of the present disclosure and may include various changes, substitutions, and alterations herein without departing from the scope of the present disclosure.

The invention claimed is:

1. An encapsulated splice chuck comprising:

a splice chuck body, a body encapsulation positioned about an exterior surface of the splice chuck body;

a first forcing cone threadedly coupled to the splice chuck body, the first forcing cone including a tapered inner surface;

a first forcing cone encapsulation positioned about an exterior surface of the first forcing cone;

a first set of wedges positioned within the first forcing cone;

a second forcing cone mechanically coupled to the splice chuck body, the second forcing cone including a tapered inner surface;

a second forcing cone encapsulation positioned about an exterior surface of the second forcing cone; and a second set of wedges positioned within the second forcing cone;

wherein the first and second cone encapsulations are each separate from the body encapsulation so that as each forcing cone is coupled to the splice chuck body, the respective forcing cone encapsulation at least partially engages the body encapsulation.

2. The encapsulated splice chuck of claim 1, further comprising:

a central disk positioned within the splice chuck body;

a first spring extending between the first set of wedges and the central disk; and a second spring extending between the second set of wedges and the central disk.

3. The encapsulated splice chuck of claim 1, further comprising:

a first seal positioned between the first forcing cone and the splice chuck body so as to retard fluid ingress between the body encapsulation and the first forcing cone encapsulation; and a second seal positioned between the second forcing cone and the splice chuck body so as to retard fluid ingress between the body encapsulation and the second forcing cone encapsulation.

4. The encapsulated splice chuck of claim 1, wherein the splice chuck body comprises an internal thread, and the first and second forcing cones each include an external thread, and wherein the first and second forcing cones are threadedly coupled to the splice chuck body.

5. The encapsulated splice chuck of claim 1, wherein the first set of wedges comprises two or more wedges, and wherein the second set of wedges comprises two or more wedges.

6. The encapsulated splice chuck of claim 1, further comprising a sheathing seal mechanically coupled to the first forcing cone.

7. The encapsulated splice chuck of claim 6, wherein the sheathing seal further comprises a tab and the first forcing cone further comprises a matching slot formed in the first forcing cone encapsulation, the tab fitting into the matching slot.

8. The encapsulated splice chuck of claim 1, wherein the body encapsulation, first forcing cone encapsulation, and second forcing cone encapsulation are formed from one or more of epoxy, phenolic resin, nylon, polyethylene, and polystyrene.

9. The encapsulated splice chuck of claim 1, wherein the body encapsulation is molded to the exterior surface of the splice chuck body.

10. The encapsulated splice chuck of claim 1, wherein the first forcing cone encapsulation is molded to the exterior surface of the first forcing cone, and the second forcing cone encapsulation is molded to the exterior surface of the second forcing cone.

11. The encapsulated splice chuck of claim 1, wherein the body encapsulation, the first forcing cone encapsulation, and the second forcing cone encapsulation protect one or more of the splice chuck body, forcing cones, and sets of wedges from exposure to a surrounding environment.

12. The encapsulated splice chuck of claim 1, wherein each forcing cone has an outside end and an inside end and wherein the inner diameter of each forcing cone is smaller at the outside end than at the inside end of that forcing cone.

13. A method comprising:

providing an encapsulated splice chuck, the encapsulated splice chuck comprising:

a splice chuck body, a body encapsulation positioned about an exterior surface of the splice chuck body;

a first forcing cone threadedly coupled to the splice chuck body, the first forcing cone including a tapered inner surface;

a first forcing cone encapsulation positioned about an exterior surface of the first forcing cone;

a first set of wedges positioned within the first forcing cone;

a second forcing cone mechanically coupled to the splice chuck body, the second forcing cone including a tapered inner surface;

a second forcing cone encapsulation positioned about an exterior surface of the second forcing cone; and a second set of wedges positioned within the second forcing cone;

wherein the first and second cone encapsulations are each separate from the body encapsulation so that as each forcing cone is coupled to the splice chuck body, the respective forcing cone encapsulation at least partially engages the body encapsulation;

providing a first and second tension member, each tension member including a strand;

inserting the strand of the first tension member into the first set of wedges within the first forcing cone;

inserting the strand of the second tension member into the second set of wedges within the second forcing cone; and applying tension to the first and second tension members to pull the first and second sets of wedges into the first and second forcing cones and retard the first and second tension members from being removed from the encapsulated splice chuck.

14. A system comprising:

a concrete form; and a post-tensioning tendon, the post-tensioning tendon including:

a first anchor;

a second anchor;

a first tension member;

a second tension member; and an encapsulated splice chuck mechanically coupled to the first and second tension members, the encapsulated splice chuck including:

a splice chuck body, a body encapsulation positioned about an exterior surface of the splice chuck body;

a first forcing cone threadedly coupled to the splice chuck body, the first forcing cone including a tapered inner surface;

a first forcing cone encapsulation positioned about an exterior surface of the first forcing cone;

a first set of wedges positioned within the first forcing cone;

a second forcing cone mechanically coupled to the splice chuck body, the second forcing cone including a tapered inner surface;

a second forcing cone encapsulation positioned about an exterior surface of the second forcing cone; and a second set of wedges positioned within the second forcing cone, wherein the first and second cone encapsulations are each separate from the body encapsulation so that as each forcing cone is coupled to the splice chuck body, the respective forcing cone encapsulation at least partially engages the body encapsulation.

15. The system of claim 14, further comprising:

a central disk positioned within the splice chuck body;

a first spring extending between the first set of wedges and the central disk; and a second spring extending between the second set of wedges and the central disk.

16. The system of claim 14, further comprising:

a first seal positioned between the first forcing cone and the splice chuck body so as to retard fluid ingress between the body encapsulation and the first forcing cone encapsulation; and a second seal positioned between the second forcing cone and the splice chuck body so as to retard fluid ingress between the body encapsulation and the second forcing cone encapsulation.

17. The system of claim 14, wherein the splice chuck body comprises an internal thread, and the first and second forcing cones each include an external thread, and wherein the first and second forcing cones are threadedly coupled to the splice chuck body.

18. The system of claim 14, wherein the first set of wedges comprises two or more wedges, and wherein the second set of wedges comprises two or more wedges.

* * * * *